US008181396B1

(12) United States Patent
Kunz

(10) Patent No.: US 8,181,396 B1
(45) Date of Patent: May 22, 2012

(54) MOUNTING SYSTEM FOR A COIL SPRING IN A WINDOW COUNTERBALANCE ASSEMBLY

(76) Inventor: John R. Kunz, Douglassville, PA (US)

( * ) Notice: Subject to any disclaimer, the term of this patent is extended or adjusted under 35 U.S.C. 154(b) by 947 days.

(21) Appl. No.: 12/137,409

(22) Filed: Jun. 11, 2008

(51) Int. Cl.
*E05F 1/00* (2006.01)

(52) U.S. Cl. ..... 49/447; 16/197

(58) Field of Classification Search ..... 49/445, 49/446, 447, 448; 16/193, 197
See application file for complete search history.

(56) References Cited

U.S. PATENT DOCUMENTS 2,732,594 A * 1/1956 Adams et al. ..... 16/198
3,160,914 A 12/1964 Brienza
3,475,865 A * 11/1969 Arnes ..... 49/445
5,232,208 A * 8/1993 Braid et al. ..... 267/156
6,934,998 B1 * 8/2005 Shuler ..... 16/193
7,980,028 B1 * 7/2011 Kunz ..... 49/447
2002/0116786 A1 * 8/2002 Guillemet et al. ..... 16/197
2005/0198775 A1 * 9/2005 Pettit et al. ..... 16/197

FOREIGN PATENT DOCUMENTS

JP 05133153 A * 5/1993

* cited by examiner

*Primary Examiner* — Jerry Redman
(74) *Attorney, Agent, or Firm* — LaMorte & Associates P.C.

(57) ABSTRACT

A counterbalance system for counterbalancing the weight of a window sash in a window frame and the structure of the springs that provide the counterbalance force. Guide tracks are provided on a window frame to guide the movement of the window sash. Mounting slots are formed through the guide tracks at various points. Coil springs are provided to create the counterbalance force. Each coil spring is a coil of wound steel ribbon that has one end bent into an anchor configuration. The anchor configuration passes into, and is retained by, one of the mounting slots. This anchors one end of the coil spring to the guide track.

8 Claims, 6 Drawing Sheets

MOUNTING SYSTEM FOR A COIL SPRING IN A WINDOW COUNTERBALANCE ASSEMBLY

BACKGROUND OF THE INVENTION

1. Field of the Invention

In general, the present invention relates to counterbalance systems for windows that prevent open window sashes from closing under the force of their own weight. More particularly, the present invention system relates to the structure of coil springs used in such counterbalance systems and the mechanism used to anchor the coil springs to the window frame.

2. Description of the Prior Art

There are many types of windows that are used in modern construction. Some windows are designed to open, some are not. Of the windows that are designed to open, some windows have sashes that open vertically and others have sashes that slide open laterally, or rotate outwardly.

Windows that have vertically opening sashes are the most common window used in residential home construction. Vertically opening windows are either single-hung, having one sash that opens, or double-hung, having two sashes that open. In both single-hung and double-hung windows, the same system is used to hold a window sash up once it is open. If no system is used, gravity causes the sash of the window to close as soon as it is opened and released.

In low quality windows, friction between the window sash and the window frame is relied upon to hold a sash open. Such a system is highly unreliable because the friction relied upon varies as parts wear, expand, contract and are painted. It is for this reason that most single and double-hung windows are manufactured with counterbalance systems.

Early window sash counterbalance systems were simply weights that were attached to the sash. The weights were attached to a sash by a rope or chain that passed over a pulley at the top of the window frame. Such old counterbalance systems are exemplified by U.S. Pat. No. 3,160,914 to Brienza, entitled Sash Weight Mounting Means. Such counterbalance systems required window wells in which the weights move. Accordingly, such windows were difficult to insulate. Additionally, the rough opening needed for the window had to be much larger than the window sashes. Finally, window sashes attached to such counterbalance systems could not be tilted for cleaning or otherwise removed from the window frame.

Recognizing the many disadvantages of window well counterbalance systems, windows were manufactured with spring loaded counterbalance systems. Spring loaded counterbalance systems relied upon the pulling strength of a spring, rather than a hanging weight, to counterbalance the weight of a window sash. Accordingly, window wells for weights were no longer required.

Counterbalancing a window sash with a coil spring is a fairly simple matter. One end of the coil spring is attached to the window frame while the body of the coil spring is engaged by the sash. One of the simplest examples of a coil spring counterbalance system is shown in U.S. Pat. No. 2,732,594 to Adams, entitled Double Hung Window Sash. The difficulties with such a system occur when a window manufacturer wants to use coil springs to counterbalance a window sash while simultaneously making a window tiltable or removable for cleaning.

In modern tilt-in windows, the window sash tilts for cleaning but never completely leaves the window frame. Counterbalancing such windows can, therefore, be accomplished by attaching coil springs to the end of the window sash that never leaves the frame.

Counterbalancing a window with a sash that is removable is far more difficult. In a window with a removable sash, the counterbalance system must have the ability to connect and disconnect from the sash. The counterbalance system commonly used for a side loading window with a removable sash is a "block and tackle" counterbalance. A block and tackle counterbalance contains pulleys, string, and a spring that maintains tension on the string. The end of the string is typically attached to the window sash with a clip. When a window sash is being removed completely from a window frame, the clip must be manually detached from the sash. Once detached, the sash can be removed while the block and tackle counterbalance system remains behind in the jamb of the window frame.

There are many problems associated with prior art block and tackle counterbalance systems. Window manufactures would therefore like to use counterbalance systems with coil springs in side load windows. A system for applying a coil spring counterbalance system to a side load window is shown in co-pending patent application Ser. No. 11/827,968 to Kunz, entitled Coil Spring Counterbalance System For Side Loading Window Sashes.

In coil spring counterbalance systems, a single coil spring is used one each side of a light sashes. Multiple coil springs are used on windows with heavy sashes. The coil springs provide the counterbalance force to the window sashes needed to maintain the sashes in place. In order for the coil springs to resist the weight of a window sash, one end of the spring coil must be anchored to a stationary point along the window frame. In this manner, the coil spring winds and unwinds as a window sash is opened and closed. In the prior art, coil springs are typically anchored to the window frame using a screw or using an anchor block that is screwed in place. Both techniques have disadvantages. If a coil spring is attached to the window frame directly with a screw, the coil spring must be partially unwound in order to provide an accessible segment of the coil spring for attachment. This means that the coil spring must be physically manipulated while a screw is driven through the coil spring and into the window frame. Partially unwinding a strong coil spring while driving a screw through the coil spring is a complicated maneuver that can only be performed by hand. Consequently, the use of an anchor screw adds significantly to the labor and costs associated with the manufacture of the window.

Furthermore, screw anchors tend to loosen over time. If the anchor screw loosens and protrudes, the screw can interfere with the movement of the window sashes. If the screw pulls loose, the coil spring is released and fails to function.

Anchor blocks are more reliable than anchor screws. However, anchor blocks protrude into the guide track of the window frame. Window blocks, therefore, present an obstruction in the window frame that may inhibit a window sash from fully opening.

A need therefore exists in the field of side loading windows for a counterbalance system that has an improved spring anchor mounting system that is reliable and does not limit the movement of window sashes. A need also exists in the field of side loading windows for a coil spring that can be assembled into the counterbalance system of a window in a more labor efficient manner. These needs are met by the present invention as described and claimed below.

SUMMARY OF THE INVENTION

The present invention is a counterbalance system for counterbalancing the weight of a window sash in a window frame and the structure of the springs that provide the counterbalance force.

Guide tracks are provided on a window frame to guide the movement of the window sash. Mounting slots are formed through the guide tracks at various points. Coil springs are provided to create the counterbalance force. Each coil spring is a coil of wound steel ribbon that has one end bent into an anchor configuration. The anchor configuration passes into, and is retained by, one of the mounting slots. This anchors one end of the coil spring to the guide track.

A spring carriage is coupled to both the window sash and the coil spring. The spring carriage rides in the guide track as the window sash is moved up and down, causing the coil spring to wind and unwind. Due to the mounting of the coil spring, the steel ribbon of the coil spring biases itself against the guide track as it unwinds. This prevents the steel ribbon of the coil spring from buckling if the window is rapidly opened. It also keeps the steel ribbon out of sight as the window sash is opened and closed.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
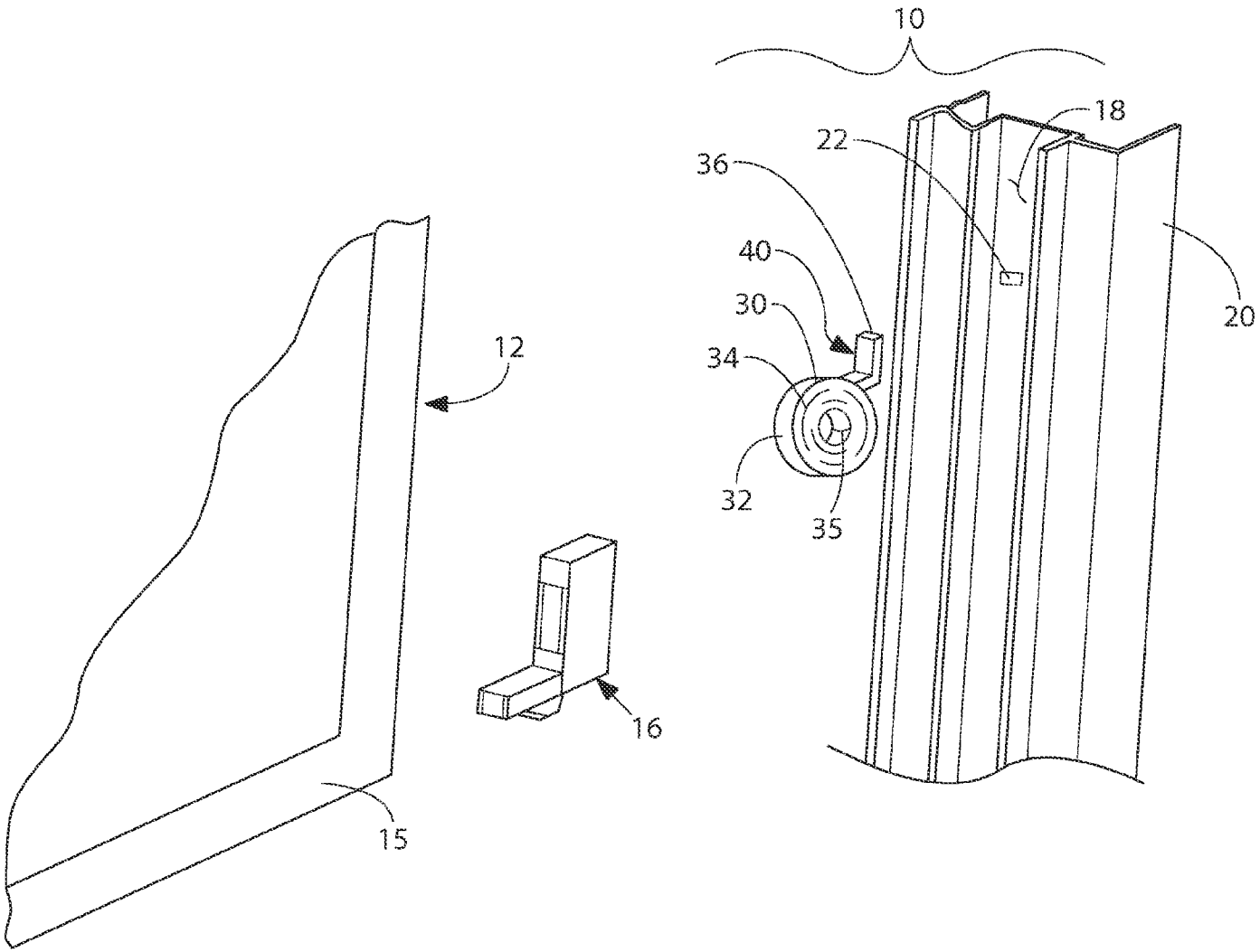
FIG. 1 is a fragmented perspective view of an exemplary embodiment of a counterbalance system for a window.

Referring to FIG. 1, the counterbalance system 10 for a window sash 12 of a side load window is shown. The window sash 12 has a sash frame 15 that selectively engages a spring carriage 16. In the shown embodiment, the spring carriage 16 holds a single coil spring 30. However, it will be understood that spring carriage 16 can be configured to hold multiple coil springs. A spring carriage 16 with a capacity of one spring coil 30 has been selected for the sake of clarity.

The spring carriage 16 rides in a guide track 18 that is formed in the window frame 20 on the sides of the window sash 12. In a side load window, the guide track 18 often has an extruded plastic construction. However, aluminum and wood tracks also exist. Mounting slots 22 are formed in the guide track 18 at the points where a coil spring 30 is to be connected to the window frame 20. The mounting slots 22 each have a width that is just slightly wider than the steel ribbon 32 used to create the coil spring 30. Furthermore, each mounting slot 22 has a height that is slightly larger than the gauge of steel used in the steel ribbon 32.

The coil spring 30 is a wound coil spring that is biased into a coiled configuration 34. Accordingly, the coil spring 30 resists being unwound. A coil spring 30 is made from a steel ribbon 32 that has two ends 35, 36. When the steel ribbon 32 is wound into the shape of the coil spring 30, its first end 35 is located on the interior of the coiled configuration 34. The second end 36 of the steel ribbon 32 terminates on the exterior of the coiled configuration 34.

The second end 36 of the steel ribbon 32 is formed into a slot anchor configuration 40. The slot anchor configuration 40 is shaped to engage a mounting slot 22 in the guide track 18, as will later be explained in detail.

Figure 2:
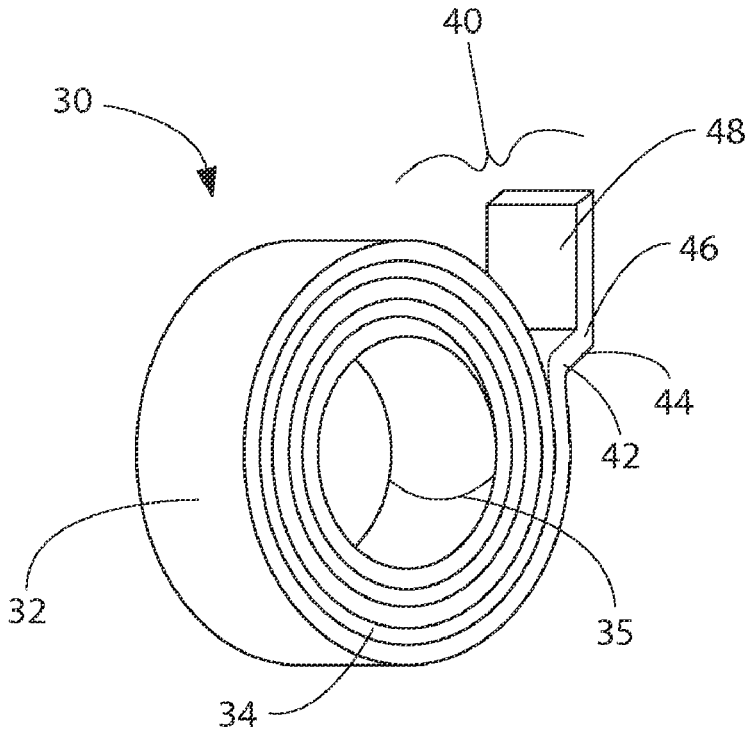
FIG. 2 is an enlarged perspective view of a coil spring used within the counterbalance system.

Referring to FIG. 2, it can be seen that the structure of the slot anchor configuration 40 begins at a first bend 42. The steel ribbon 32 of the coil spring 30 follows the coiled configuration 34 from its first end 35 until it reaches the first bend 42. At the first bend 42, the direction of the steel ribbon 32 changes by ninety degrees. Accordingly, after the first bend 42, the steel ribbon 32 extends away radially from the center of the coiled configuration 34.

The steel ribbon 32 extends through a short lateral section 44 as it progresses between a first bend 42 and a second bend 46. The lateral section 44 has a length L1. At the second bend 46, the steel ribbon 32 bends ninety degrees back into its original orientation. This creates a locking lip 48 that extends from the second bend 46 to the second end 36 of the steel ribbon 32. The locking lip 48 has a length of at least one-quarter inch so that it will not inadvertently retreat out of the mounting slot 22.

Figure 3:
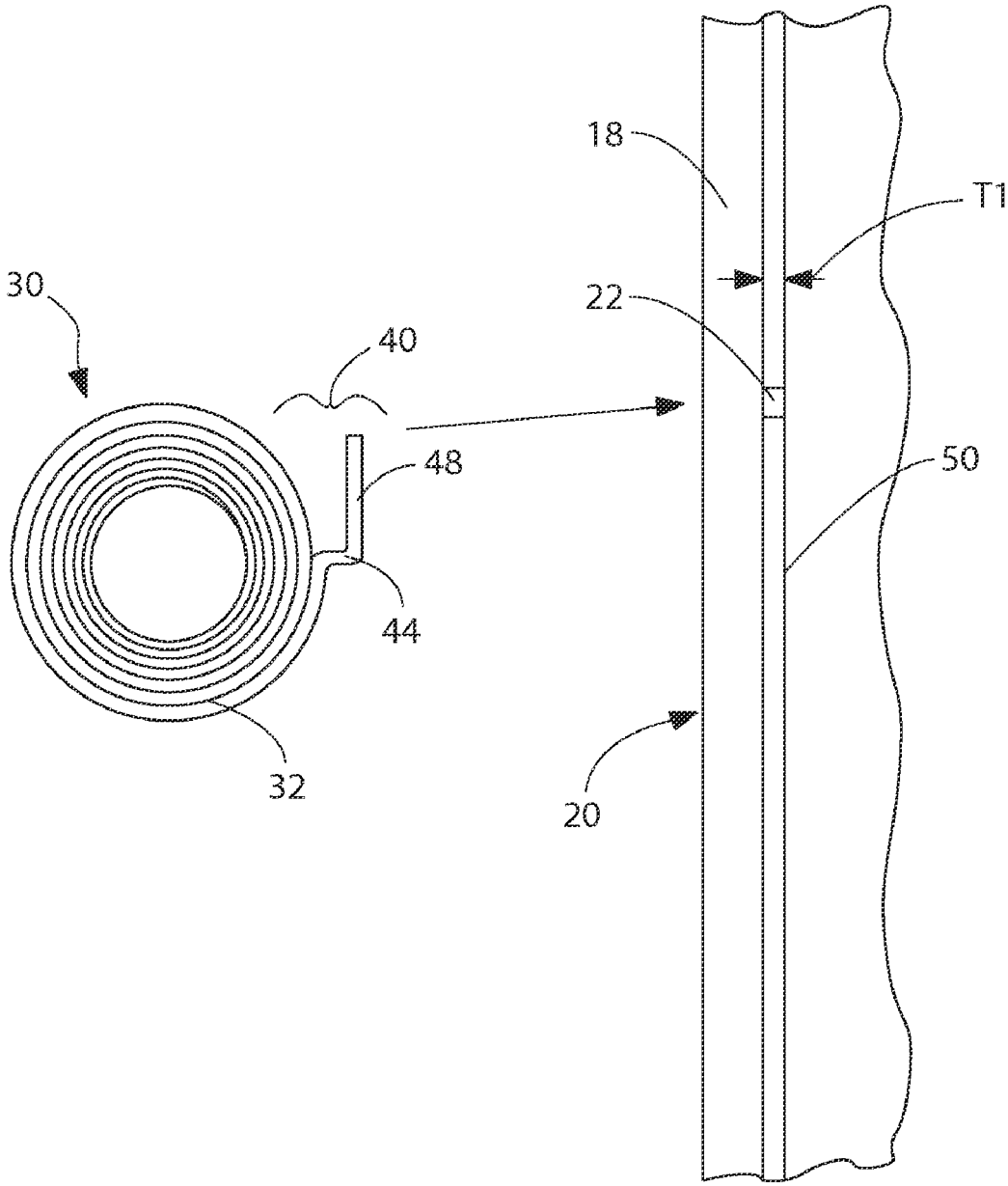
FIG. 3 a side view of a coil spring and a selectively cross-sectional view of a segment of a guide track containing a mounting slot.
Figure 4:
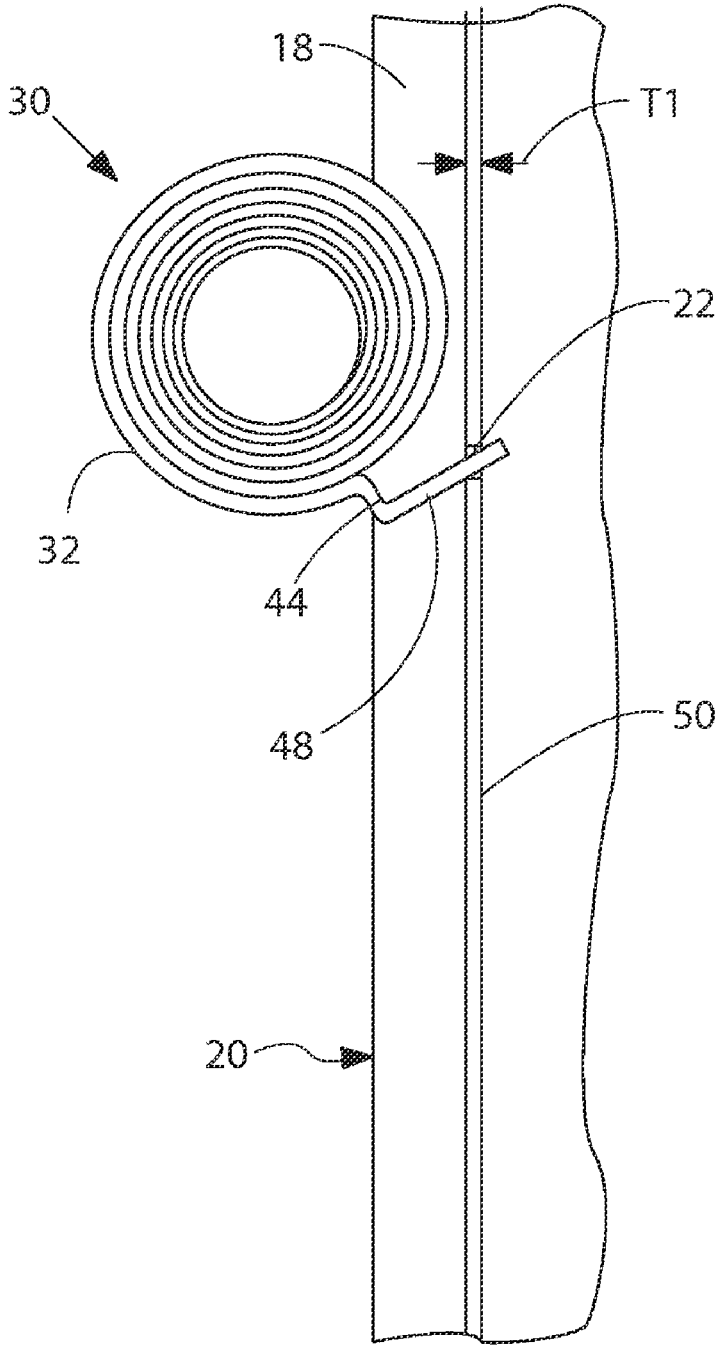
FIG. 4 shows the same matter as FIG. 3 with the coil spring partially engaging the mounting slot.
Figure 5:
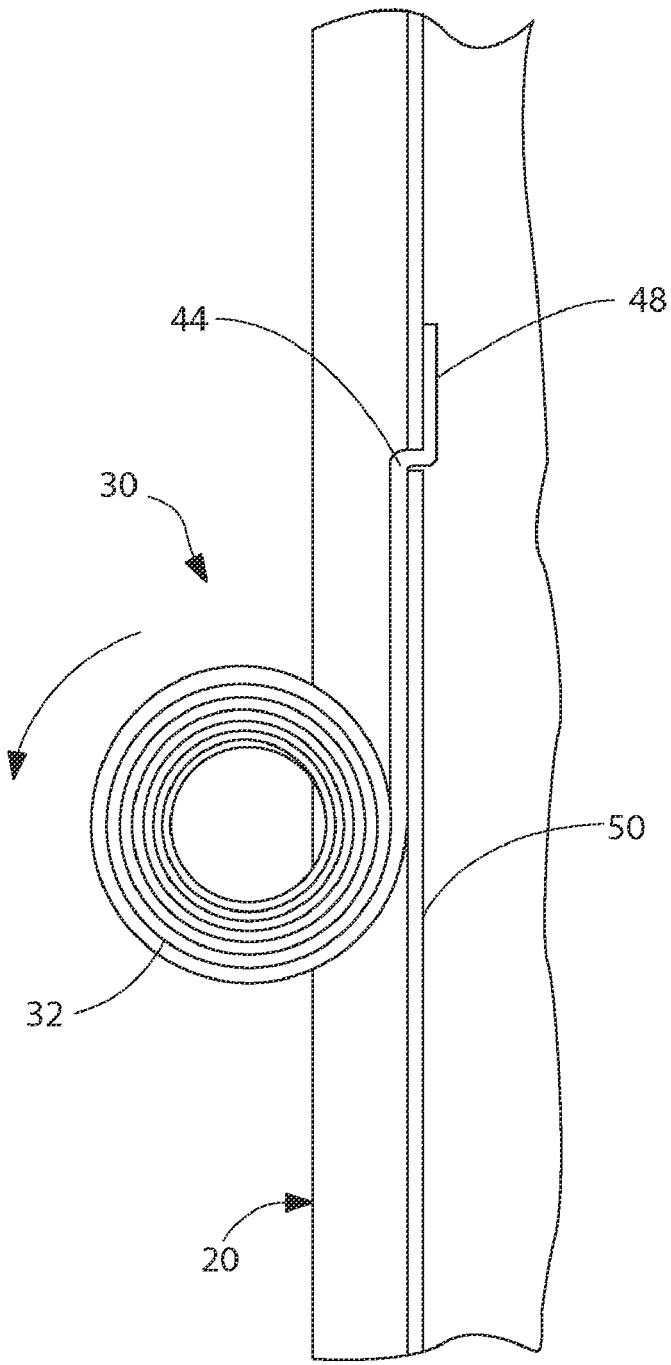
FIG. 5 shows the same matter as FIG. 4 with the coil spring fully engaging the mounting slot.

Referring to FIG. 3, FIG. 4, and FIG. 5, it can be seen that the locking lip 48 and the lateral section 44 of the slot anchor configuration 40 pass through the mounting slot 22 in the guide track 18 of the window frame 20. The mounting slot 22 is formed through the rear wall 50 of the guide track 18. The rear wall 50 of the guide track 18 is made from extruded plastic and has a thickness T1 that is typically about $\frac{1}{8}^{th}$ of an inch. The lateral section 44 of the slot anchor configuration 40 has a length that is just slightly larger than the thickness T1 of the rear wall 50 of the guide track 18. As a consequence, when the slot anchor configuration 40 is inserted into the mounting slot 22, the locking lip 48 presses flush against the inside surface of the rear wall 50 of the guide track 18. The slot anchor configuration 40 is, therefore, mechanically interlocked with the mounting slot 22 and cannot move up or down.

As the coil spring 30 is pulled downward by the movement of the windowsill, the coil spring 30 begins to unwind. The curvature of the coil spring 30 causes the locking lip 48 to press against the inside of the rear wall 50 of the guide track 18. More importantly, the sections of the coil spring 30 that unwind from the coiled configuration 34 are biased against the outside surface of the rear wall 50 of the guide track 18. The steel ribbon 32, therefore, remains pressed against the guide track 18 and out of sight as the coil spring 30 moves up and down while winding and unwinding.

The slot anchor configuration 40 can be inserted into the mounting slot 22 by a simple manipulation of the coil spring 30. This manipulation can be easily automated for manufacture. Furthermore, the coil spring 30 does not need to be partially unwound in order to connect the coil spring 30 to the guide track 18. Lastly, the mechanical interconnection between the slot anchor configuration 40 and the mounting slot 22 does not require the use of mechanical fasteners, such as screws or locking pins. It will therefore be understood that the slot anchor configuration 40 at the second end of the coil spring 30 can be connected to a guide track 18 in a window frame in a highly cost effective and labor efficient manner.

Figure 6:
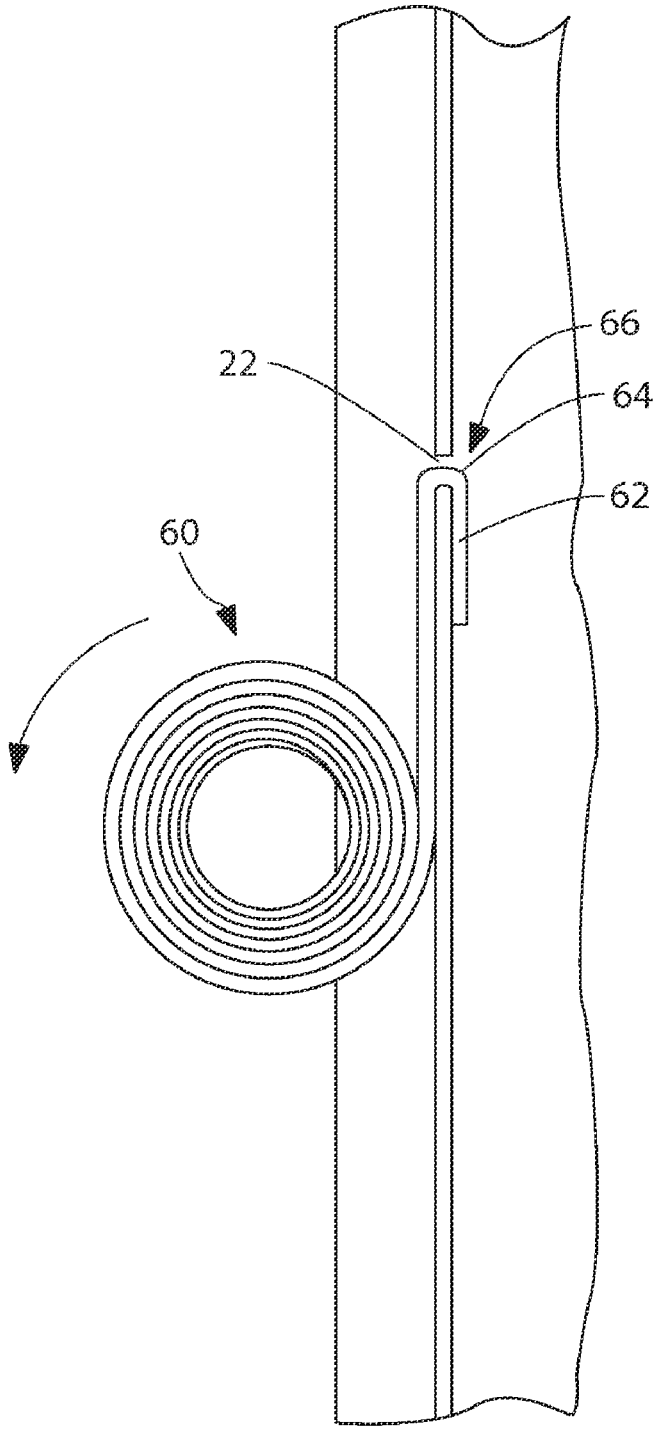
FIG. 6 shows an alternate embodiment of a coil spring and a selectively cross-sectioned view of a segment of a guide track containing a mounting slot.

Referring to FIG. 6, an alternate embodiment of a coil spring 60 is shown. In this embodiment, the coil spring 60 has the same configuration as the coil spring previously shown, except that the locking lip 62 is bent in the opposite direction at the second bend 64. As a result, the slot anchor configuration 66 is provided with a hooked shape.

When inserted into a mounting slot 22, it will be understood that locking lip 62 of the slot anchor configuration 66 will pass through the mounting slot 22. The locking lip 62 then extends downwardly and presses against the inside surface of the rear wall 50 of the guide track 18.

It will be understood that the embodiments of the present invention are merely exemplary and that a person skilled in the art can make many variations to those embodiments. For instance, the length of the locking lip can be varied and the curvature of the locking lip can be varied. The first and second bends can be more or less than ninety degrees. All such variations, modifications, and alternate embodiments are intended to be included within the scope of the present invention as defined by the claims.

What is claimed is:

1. A counterbalance system for counterbalancing the weight of a window sash in a window frame, said system comprising:

a guide track coupled to said window frame, said guide track having a mounting slot formed therein;

a coil spring of steel ribbon wound into a coiled configuration, said coil spring having one end bent into an anchor configuration, wherein said anchor configuration includes a first ninety degree bend in said steel ribbon causes said steel ribbon to radially extend from said coiled configuration, and a second ninety degree bend in said steel ribbon, wherein said first ninety degree bend and said second ninety degree bend are bent in opposed directions and a lateral section of said steel ribbon extends between said first ninety degree bend and said second ninety degree bend, and wherein said anchor configuration passes into, and is retained by, said mounting slot, therein anchoring said one end of said coil spring to said mounting slot; and a spring carriage coupled to said window sash and extending between said window sash and said guide track, wherein said spring carriage retains said coiled configuration of said coil spring between said window sash and said guide track so that said coil spring moves with said window sash in said guide track as said window sash is moved up and down causing said coil spring to wind and unwind.

2. The system according to claim 1, wherein said mounting slot has a predetermined depth and said lateral section has a length at least as long as said predetermined depth.

3. The system according to claim 2, wherein a locking lip extends between said second bend and said one end, wherein said locking lip has a length of at least one-quarter inch.

4. The system according to claim 3, wherein said mounting slot is formed in a wall of said guide track, wherein said mounting slot extends through said wall from an exterior surface to an interior surface.

5. The system according to claim 4, wherein said lateral section of said anchor configuration extends through said mounting slot when said anchor configuration of said coil spring is engaged with said mounting slot.

6. The system according to claim 5, wherein said locking lip is biased against said interior surface of said wall when said coil spring is engaged with said mounting slot.

7. A coil spring for a window counterbalance system, said coil spring comprising:

a steel ribbon wound into a coiled section, wherein said steel ribbon terminates with an anchoring configuration external of said coiled section, said anchoring configuration including a first ninety degree bend, wherein said steel ribbon turns away from said coiled section into a lateral section that radially extends from said coiled section, and a second ninety degree bend that bends in a direction opposed to said first ninety degree bend, wherein said anchoring configuration turns away from said lateral section into a locking lip.

8. The coil spring according to claim 7, wherein said locking lip extends between said second bend and a ribbon end, wherein said locking lip has a length of at least one-quarter inch.

* * * * *